US007309841B2

(12) United States Patent
Hillman

(10) Patent No.: US 7,309,841 B2
(45) Date of Patent: Dec. 18, 2007

(54) MANUAL RESET SWITCH COVER ASSEMBLY

(76) Inventor: Kenneth Brad Hillman, P.O. Box 4172 PPSE, Edmonton, Alberta (CA) T6E 4T3

( * ) Notice: Subject to any disclaimer, the term of this patent is extended or adjusted under 35 U.S.C. 154(b) by 32 days.

(21) Appl. No.: 11/253,365

(22) Filed: Oct. 19, 2005

(65) Prior Publication Data

US 2006/0086600 A1 Apr. 27, 2006

(30) Foreign Application Priority Data

Oct. 19, 2004 (CA) ..... 2485278

(51) Int. Cl.
*H01H 3/12* (2006.01)

(52) U.S. Cl. ..... 200/331; 200/345

(58) Field of Classification Search ..... 200/329–335, 200/341–345, 81 R, 81.5, 83 J, 83 R, 82 R, 200/83 Q See application file for complete search history.

(56) References Cited

U.S. PATENT DOCUMENTS 4,260,862 A * 4/1981 Orcutt ..... 200/81 R
4,473,729 A * 9/1984 Ting et al. ..... 200/83 Z
5,461,208 A * 10/1995 McKenna ..... 200/83 J
6,756,553 B1 * 6/2004 Yamaguchi et al. ..... 200/339

FOREIGN PATENT DOCUMENTS

CA 2129290 6/1998
CA 2178401 6/1999

* cited by examiner

*Primary Examiner*—Elvin Enad
*Assistant Examiner*—M. Fishman
(74) *Attorney, Agent, or Firm*—Dinsmore & Shohl

(57) ABSTRACT

The present invention is concerned with cover assemblies for manually resetting pressure switches used on oil and gas pipelines. The cover assembly encloses a volume of space on the pressure switch that houses a reset switch which is activated by depressing a button located on top of the reset switch. The cover assembly has a housing with a rod or plunger extending through the housing. On the exterior end of the rod is a protective cap and on the interior is a flexible rubber hemispherical bumper. A spring disposed between the cap and the exterior side of the cover housing biases the bumper away from the button on the reset switch. In operation, the cap is pushed towards the housing causing the rod or plunger to advance towards and contact the reset switch button. The bumper deforms or balloons outward upon contact with the button so as to impart sufficient force to depress the button but not so much force so as to damage or break the reset switch itself. When the cap is released, the spring moves the bumper away from the reset switch allowing the bumper to return to its original shape.

13 Claims, 4 Drawing Sheets

MANUAL RESET SWITCH COVER ASSEMBLY

FIELD OF THE INVENTION

The present invention relates to cover assemblies for manually operating reset switches, specifically, reset switches mounted on pressure switches used on oil and gas pipelines.

BACKGROUND OF THE INVENTION

Pressure switches used on oil and gas pipelines operate on a change of the fluid pressure flowing through the pipeline. These pressure switches often have manual reset mechanisms that are activated by a rod which passes through a cap assembly attached to the pressure switch itself. The rod is pushed in towards the reset switch located under the cap assembly to depress a button on the reset switch. Such mechanisms are described in Canadian patents 2,129,290 and 2,178,401. In operation, it is not uncommon that excessive force is used in depressing the rod on the cap assembly to activate the reset switch. This excessive force often physically breaks the reset switch mechanism.

It is, therefore, desirable to have a cover assembly for manually operating a reset switch that prevents excessive force from being applied to the reset switch.

SUMMARY OF THE INVENTION

The present invention is concerned with cover assemblies for manually resetting pressure switches used on oil and gas pipelines. Pressure switches have reset switches that are operated by depressing a button switch located on top of the reset switch.

The present invention comprises a cover assembly that attaches to the pressure switch to enclose a volume of space that houses the reset switch. The button switch on the reset switch faces upwards towards the cover housing. The housing has a bore extending from the exterior towards the button switch. Slidably mounted in the bore is a rod or plunger that has an exterior end and an interior end. Mounted on the exterior end of the rod or plunger is a cap that extends radially outward from the rod forming the skirt that circumferentially surrounds the rod or plunger.

Disposed between the cap and the exterior of the housing is a spring. The spring biases the rod or plunger towards the exterior of the cover assembly. A stop on the interior end of the bore prevents the rod or plunger from exiting the bore on the exterior side of the housing. A stop on the exterior side of the housing limits the longitudinal movement of the rod or plunger towards the button switch.

Mounted on the interior end of the rod is a bumper designed to operate the button switch when force is applied to the cap. The bumper is resilient yet flexible such that when force is applied to the cap to advance the bumper towards and contact the button switch, the bumper will deform or balloon outwards to impart just enough force to activate the button switch but not excessive force that may damage the button switch. The bumper can comprise a hollow hemisphere of rubber having flexible walls that is releasably attached to the interior end of the rod. Furthermore, in addition to the well known use of o-rings used to seal the volume of space when the cover housing is threaded onto the pressure switch, the bias force of the spring draws the bumper towards the interior or device side of the cover housing, thereby sealing the bore from the interior of the cover housing.

Broadly stated, one aspect of the present invention is a cover assembly for a device operated at least in part by a button switch, comprising a cover housing having a device side and an exterior side, said device side further comprising means for attaching to said device, said housing adapted to cover said button switch; said housing having an exterior bore extending from said exterior side partially through said housing towards said device side, and having an interior bore coaxially aligned with said exterior bore extending from said device side towards said exterior side until abutting said exterior bore, said interior bore having a larger diameter than said exterior bore whereby the junction of said bore forms a shoulder; a rod having an exterior end and an interior end, said interior end larger in diameter than said exterior end, said exterior end adapted to slidably mount in said exterior bore and said interior end adapted to slidably mount in said interior bore when said rod is inserted exterior end first into said bores from said device side whereby said shoulder prevents said rod from sliding all the way through said bores to said exterior side; an exterior cap mounted on the exterior end of said rod, said exterior cap having a peripheral edge extending radially outward beyond said rod, the combination of said exterior cap and said rod having a limited degree of longitudinal travel; biasing means disposed between the peripheral edge of said exterior cap and said exterior side of said housing for resisting longitudinal movement of said exterior cap towards said housing; and a bumper mounted on the interior end of said rod extending towards said button switch, said bumper made of a resilient and flexible material whereby upon force being applied to said exterior cap sufficient to overcome the resistance of said biasing means and push said rod towards said button switch, said bumper activates said button switch, said bumper adapted to impart sufficient force on said button switch to activate said button switch while deforming upon contact with said button switch thereby preventing excessive force from being applied to and damaging said button switch, said bumper retracting from said button switch and substantially returning to its undeformed shape upon said force being removed from said exterior cap.

Broadly stated, another aspect of the present invention is a cover assembly for a device operated at least in part by a button switch, comprising: a cover housing having a device side and an exterior side, said device side further comprising means for attaching to said device, said housing adapted to cover said button switch; said housing having a bore extending from said device to said exterior side; a plunger slidably mounted in said bore, said plunger having an exterior cap attached to the exterior end of said plunger and biasing means disposed between said exterior cap and said exterior side of said housing for resisting longitudinal movement of said plunger towards said button switch; a first stop on the exterior side of said housing to limit the longitudinal movement of said plunger towards said device side; a second stop on the device side of said housing to limit the longitudinal movement of said plunger towards said exterior side; and a bumper mounted on the interior end of said plunger extending towards said button switch, said bumper made of a resilient and flexible material whereby upon force being applied to said exterior cap sufficient to overcome the resistance of said spring and push said plunger towards said button switch, said bumper activates said button switch, said bumper adapted to impart sufficient force on said button switch to activate said button switch while deforming upon contact with said button switch thereby preventing excessive force from being applied to and damaging said button switch, said bumper retracting from said button switch and substantially returning to its undeformed shape upon said force being removed from said exterior cap.

Broadly stated, another aspect of the present invention is a cover assembly for mounting on a pressure switch having a reset button, said cover assembly having a housing and a rod extending longitudinally through said housing towards a reset button when said cover assembly is mounted on a pressure switch, said rod having exterior and interior ends and further having limited longitudinal movement with the housing, said cover assembly being characterized in that: a bumper is mounted on the interior end of said rod; and said bumper being sufficiently flexible whereby upon force being applied to said rod such that said bumper contacts a reset button of a pressure switch when said cover assembly is mounted on a pressure switch, said bumper will deform upon contacting said reset button thereby preventing excessive force from being applied to and damaging said reset button.

DETAILED DESCRIPTION

Figure 1:
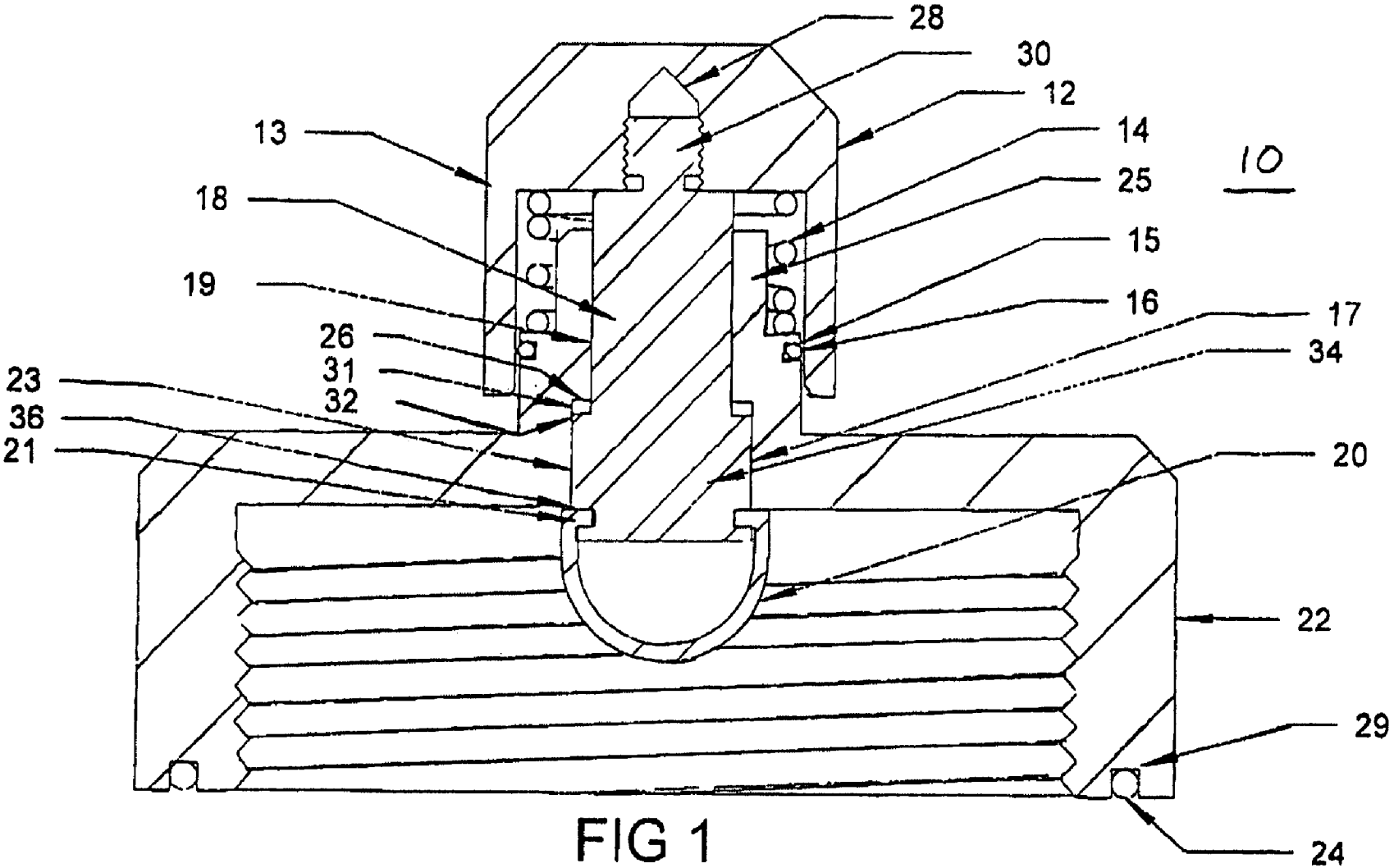
FIG. 1 is a cross-sectional view of the cover assembly of the present invention.

Referring to FIG. 1, manual reset switch cover assembly 10 is shown. Assembly 10 comprises of housing 22 having interior bore 23 and exterior bore 19. Exterior bore 19 is smaller in diameter than interior bore 23. The two bores are coaxially aligned thereby forming housing shoulder 26. Slidably mounted in bores 19 and 23 is rod 17.

Rod 17 comprises interior end 34, which is slightly smaller in diameter than interior bore 23, and exterior end 18, which is slightly smaller in diameter than exterior bore 19. The junction of interior and exterior ends 34 and 18 form rod shoulder 32. When rod 17 is inserted exterior end first into the bores from the interior or device side of housing 22, the combination of housing shoulder 26 and rod shoulder 32 acts as a stop to prevent rod 17 from sliding all the way through housing 22 to the exterior.

On exterior end 18 of rod 17 is threaded end 30 that threads into bore 28 of cap 12. Cap 12 further comprises skirt 13 and extends downwards to housing 22. Disposed between cap 12 and housing 22 is spring 14 which biases cap 12 away from housing 22.

Figure 2:
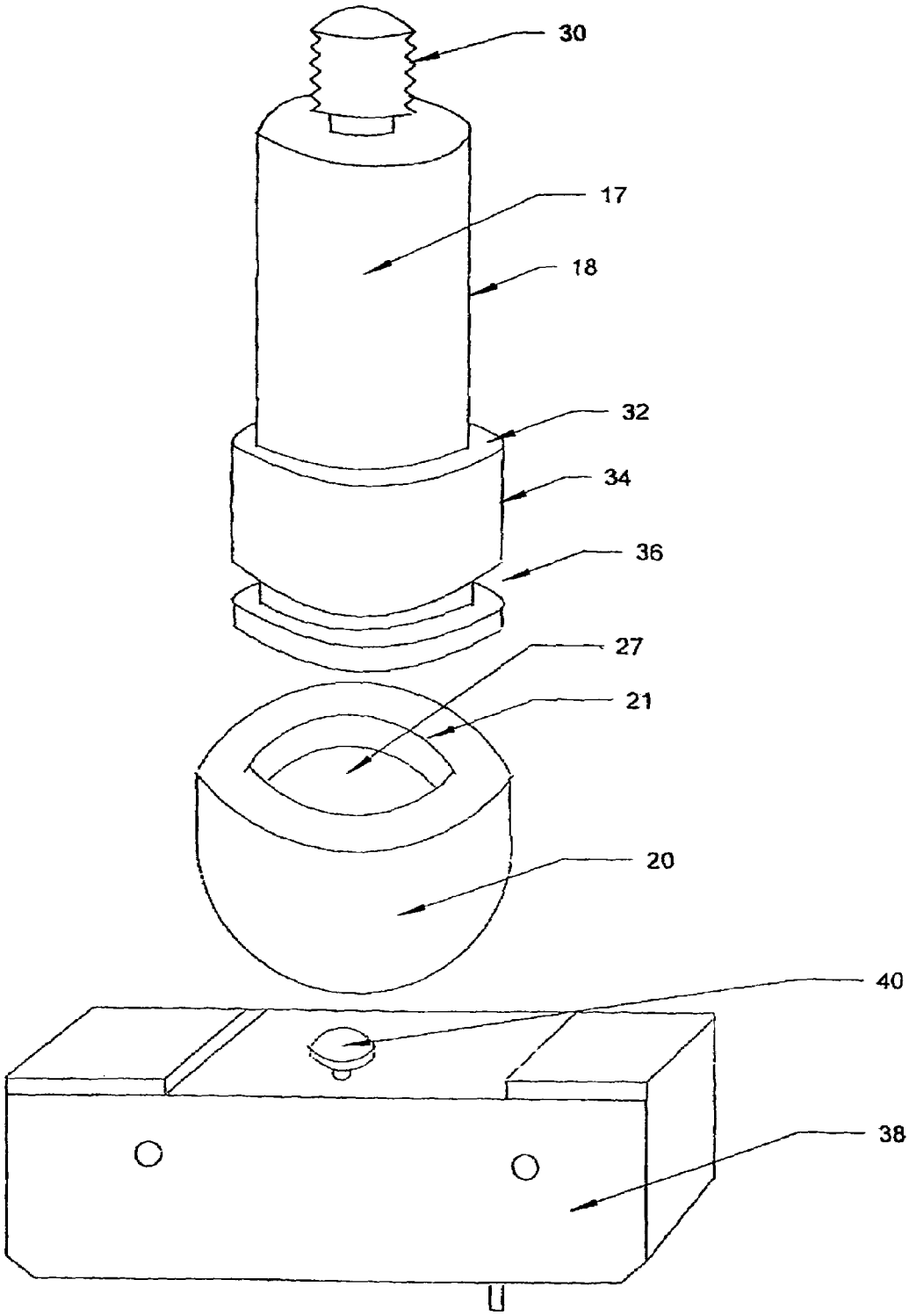
FIG. 2 is a perspective view of the bumper of the present invention located above a button switch.

Referring to FIGS. 1 and 2, interior end 34 of rod 17 comprises groove 36. Releasably attached to interior end 34 is bumper 20, which can comprise a hollow hemispherical member made of resilient yet flexible material such as rubber or other comparable materials as are known to those skilled in the art. Bumper 20 further comprises opening 27 having inward facing lip 21. The size of opening 27 is sufficiently large enough for bumper 20 to stretch and slide onto interior end 34 such that lip 21 snugly fits into groove 36 to hold bumper 20 in place on interior end 34. Groove 36 is positioned on interior end 34 such that when spring 14 biases rod 17 towards the exterior of housing 22, bumper 20 will contact the interior or device side of housing 22 before rod shoulder 32 contacts housing shoulder 26 thereby sealing the interior or device side of housing 22 from bores 23 and 19. Gap 31 is thereby formed between housing shoulder 26 and rod shoulder 32. Gap 32 can be in the range of 0.015" to 0.025".

When cap 12 is threaded onto rod 17, skirt 13 extends over sleeve 25 of housing 22 thereby covering groove 15. Disposed in groove 15 is o-ring 16 that acts as a seal between cap 12 and the exterior side of housing 22. Sleeve 25 extends upwards and towards cap 12 such that it acts as a stop to limit the longitudinal movement of rod 17 in bores 23 and 19 when cap 12 is depressed towards housing 22.

When cover assembly 10 is threaded snugly onto a pressure switch (not shown), o-ring 24 fitted in groove 29 acts as a seal between the pressure switch and cover assembly 10.

Figure 3:
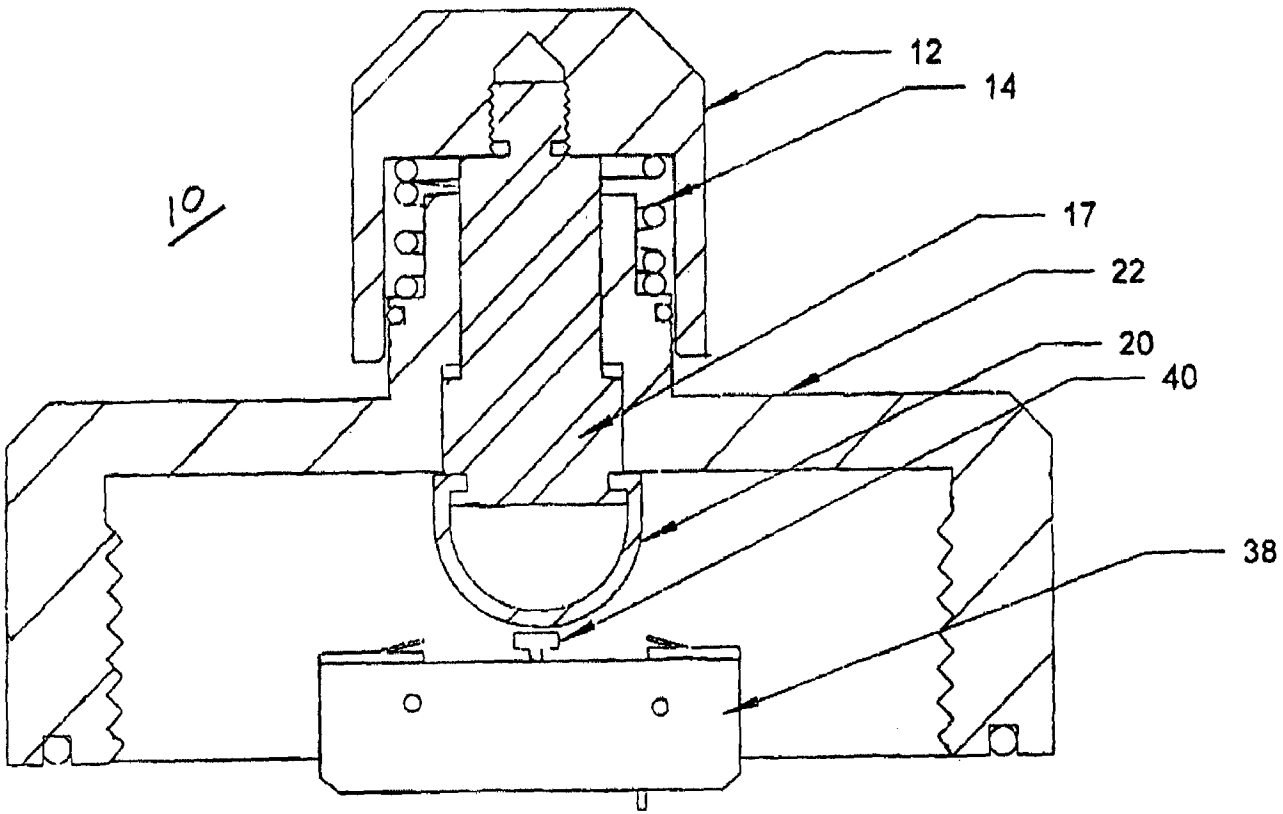
FIG. 3 is a cross-sectional side view of the present invention positioned above a button switch in the normal ready position.

Referring to FIG. 3, the normal or "ready" position of cover assembly 10 is illustrated. Spring 14 biases rod 17 to the exterior of housing 22 thereby placing bumper 20 above and out of contact with button 40 of reset switch 38.

Figure 4:
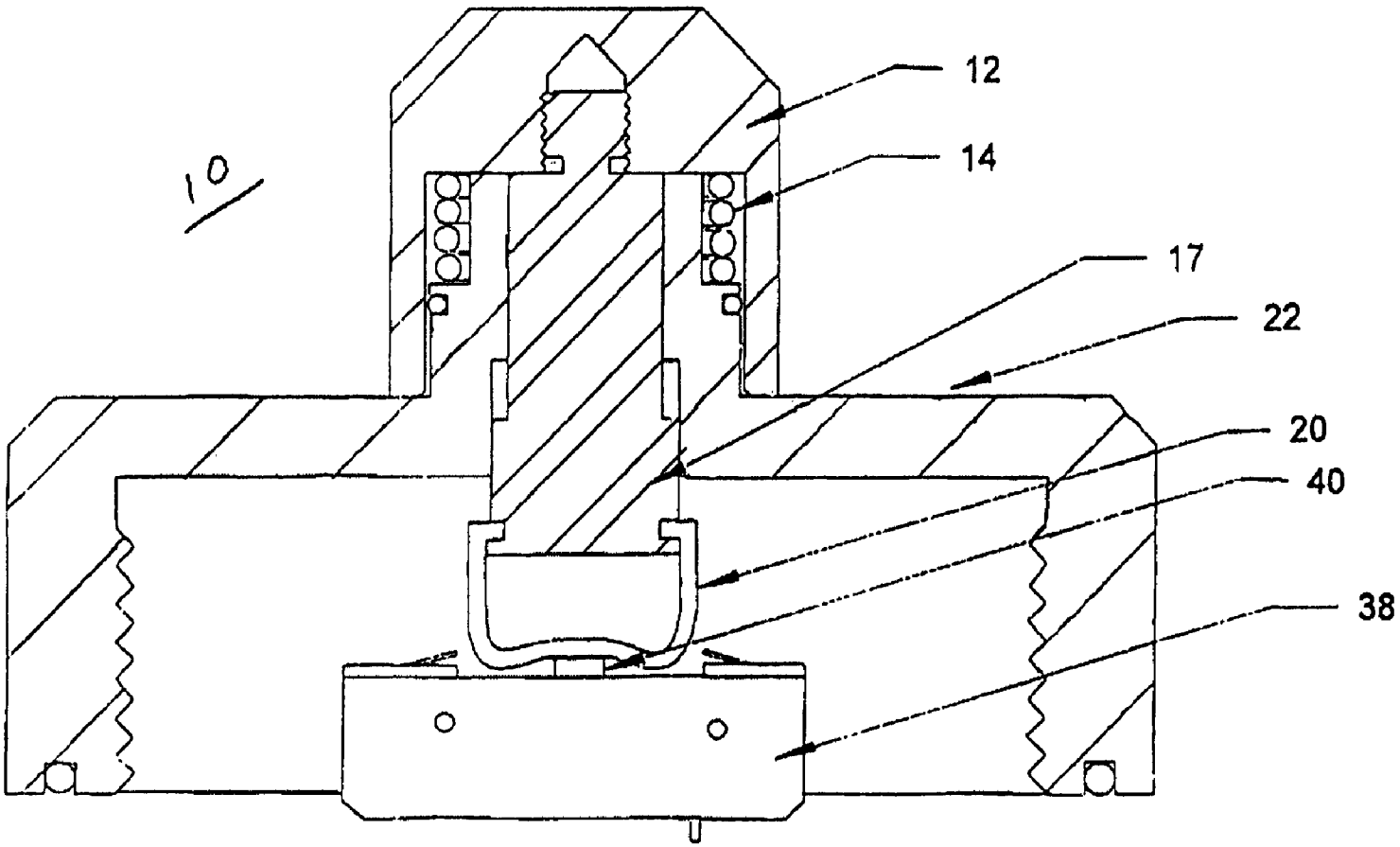
FIG. 4 is a cross-sectional side view of the present invention in the operate position.

When assembly 10 is operated, as shown in FIG. 4, force applied to cap 12 thereby compresses spring 14 and pushes rod 17 towards reset switch 38. As this is happening, bumper 20 will contact button 40 and depress it into reset switch 38 thereby resetting the pressure switch. In doing so, the flexible yet resilient bumper 20 will deform, ballooning radially outwards about button 40. The ability of bumper 20 to deform upon contacting button 40 allows sufficient force to be applied to button 40 so as to activate reset switch 38 while preventing excessive force being applied to button 40 and thereby breaking reset switch 38. When the force is removed from cap 12, spring 14 pushes cap 12 and rod 17 towards the exterior away from reset switch 38 thereby drawing bumper 20 away from button 40. Upon doing so, bumper 20 will then substantially return to its original shape.

Although a few embodiments have been shown and described, it will be appreciated by those skilled in the art that various changes and modifications might be made without departing from the scope of the invention. The terms and expressions in the preceding specification have been used therein as terms of description and not of limitation, and there is no intention in the use of such terms and expressions of excluding equivalents of the features shown and described or portions thereof, it being recognized that the scope of the invention is defined and limited only by the claims that follow.

I claim:

1. A cover assembly for a device operated at least in part by a button switch comprising:

a) a cover housing having a device side and an exterior side, said device side further comprising means for attaching to said device, said housing adapted to cover said button switch;

b) said housing having an exterior bore extending from said exterior side partially through said housing towards said device side, and having an interior bore coaxially aligned with said exterior bore extending from said device side towards said exterior side until abutting said exterior bore, said interior bore having a larger diameter than said exterior bore whereby the junction of said bore forms a shoulder;

c) a rod having an exterior end and an interior end said interior end larger in diameter than said exterior end, said exterior end adapted to slidably mount in said exterior bore and said interior end adapted to slidably mount in said interior bore when said rod is inserted exterior end first into said bores from said device side whereby said shoulder prevents said rod from sliding all the way through said bores to said exterior side;

d) an exterior cap mounted on the exterior end of said rod, said exterior cap having a peripheral edge extending radially outward beyond said rod, the combination of said exterior cap and said rod having a limited degree of longitudinal travel;

e) biasing means disposed between the peripheral edge of said exterior cap and said exterior side of said housing for resisting longitudinal movement of said exterior cap towards said housing; and f) a bumper mounted on the interior end of said rod extending towards said button switch, said bumper made of a resilient and flexible material whereby upon force being applied to said exterior cap sufficient to overcome the resistance of said biasing means and push said rod towards said button switch, said bumper activates said button switch, said bumper adapted to impart sufficient force or said button switch to activate said button switch while deforming upon contact with said button switch thereby preventing excessive force from being applied to and damaging said button switch, said bumper retracting from said button switch and substantially returning to its undeformed shape upon said force being removed from said exterior cap.

2. The cover assembly as set forth in claim 1 wherein said housing attachment means comprises threads.

3. The cover assembly as set forth in claim 1 wherein said biasing means is a spring.

4. The cover assembly as set forth in claim 1 wherein said bumper is made of rubber.

5. The cover assembly as set forth in claim 4 wherein said interior end of said rod comprises a groove disposed about the circumference of said interior end and wherein said bumper is a hollow hemispherical member having flexible walls and having an opening with an inwardly facing lip adapted to mate with said groove on said interior end and removably secure said bumper to said interior end, said bumper having a diameter larger than said interior end of said rod.

6. The cover assembly as set forth in claim 5 wherein said biasing means biases said bumper towards said device side of said housing thereby sealing said bores from said device side of said housing.

7. A cover assembly for a device operated at least in part by a button switch, comprising:

a) a cover housing having a device side and an exterior side, said device side further comprising means for attaching to said device, said housing adapted to cover said button switch;

b) said housing having a bore extending from said device to said exterior side;

c) a plunger slidably mounted in said bore, said plunger having an exterior cap attached to the exterior end of said plunger and biasing means disposed between said exterior cap and said exterior side of said housing for resisting longitudinal movement of said plunger towards said button switch;

d) a first stop on the exterior side of said housing to limit the longitudinal movement of said plunger towards said device side;

e) a second stop on the device side of said housing to limit the longitudinal movement of said plunger towards said exterior side; and f) a bumper mounted on the interior end of said plunger extending towards said button switch, said bumper made of a resilient and flexible material whereby upon force being applied to said exterior cap sufficient to overcome the resistance of said spring and push said plunger towards said button switch, said bumper activates said button switch, said bumper adapted to impart sufficient force on said button switch to activate said button switch while deforming upon contact with said button switch thereby preventing excessive force from being applied to and damaging said button switch, said bumper retracting from said button switch and substantially returning to its undeformed shape upon said force being removed from said exterior cap.

8. The cover assembly as set forth in claim 7 wherein said biasing means is a spring.

9. The cover assembly as set forth in claim 7 wherein said biasing means biases said bumper towards said device side of said housing thereby sealing said bore from said device side of said housing.

10. The cover assembly as set forth in claim 1 wherin the device is a pressure switch.

11. The cover assembly as set forth in claim 10 further comprising said pressure switch, said cover assembly being mounted on said pressure switch.

12. The cover assembly as set forth in claim 7 wherein the device is a pressure switch.

13. The cover assembly as set forth in claim 12 further comprising said pressure switch, said cover assembly being mounted on said pressure switch.

* * * * *